US008899076B2

(12) United States Patent
Takeda et al.

(10) Patent No.: US 8,899,076 B2
(45) Date of Patent: Dec. 2, 2014

(54) GAS TREATMENT DEVICE

(75) Inventors: Kazuhiro Takeda, Minato-ku (JP); Yosuke Nakagawa, Minato-ku (JP); Tomoaki Takeda, Minato-ku (JP); Yasushi Mori, Minato-ku (JP)

(73) Assignee: Mitsubishi Heavy Industries Compressor Corporation, Tokyo (JP)

( * ) Notice: Subject to any disclaimer, the term of this patent is extended or adjusted under 35 U.S.C. 154(b) by 340 days.

(21) Appl. No.: 13/265,391

(22) PCT Filed: Sep. 9, 2010

(86) PCT No.: PCT/JP2010/065468

§ 371 (c)(1),
(2), (4) Date: Dec. 6, 2011

(87) PCT Pub. No.: WO2011/040199

PCT Pub. Date: Apr. 7, 2011

(65) Prior Publication Data

US 2012/0060528 A1 Mar. 15, 2012

(30) Foreign Application Priority Data

Sep. 30, 2009 (JP) ..... 2009-227019

(51) Int. Cl.
*F25J 3/00* (2006.01)
*F25J 3/06* (2006.01)

(52) U.S. Cl.
CPC ..... *F25J 3/0695* (2013.01); *F25J 2230/30* (2013.01); *F25J 2210/06* (2013.01); *F25J 2280/02* (2013.01); *F25J 2270/12* (2013.01); *F25J 2230/20* (2013.01); *F25J 2270/04* (2013.01)
USPC ..... 62/657; 62/620; 62/628

(58) Field of Classification Search
CPC ..... F25J 1/0035; F25J 1/004; F25J 1/0287; F25J 3/0695; F25J 2270/04; F25J 2270/08
USPC ..... 62/613, 618, 622, 623, 657, 620, 628
See application file for complete search history.

(56) References Cited

U.S. PATENT DOCUMENTS 4,356,014 A * 10/1982 Higgins ..... 62/622
4,609,390 A 9/1986 Wilson (Continued)

FOREIGN PATENT DOCUMENTS

CN 1067114 12/1992
JP 2003-144827 5/2003

(Continued)

OTHER PUBLICATIONS

Russian Decision on Grant issued Mar. 26, 2013 in corresponding Russian Patent Application No. 2011144867 with English Translation.

(Continued)

*Primary Examiner* — Allana Lewin
*Assistant Examiner* — Kun Kai Ma
(74) *Attorney, Agent, or Firm* — Wenderoth, Lind & Ponack, L.L.P.

(57) ABSTRACT

Disclosed is a gas treatment device that can efficiently regulate the temperature of a gas without being affected by load. Said device is provided with: a compressor (1); a heat exchanger; a separator; an expander (3); a refrigerant gas flow control valve (22); a branching channel (13); a first branching-channel heat exchanger (24) and a second branching-channel heat exchanger (25); a first outlet channel that is connected to a liquefied process gas outlet on the separator and that bypasses the first branching-channel heat exchanger (24); a second outlet channel that is connected to an outlet on the expander (3) and that bypasses the second branching-channel heat exchanger (25); a first thermometer (23) in a main channel; a second thermometer (26) in the branching channel (13); a third thermometer (27) in the separator; a flow control valve (20) on the main channel; and a control means (5) that controls the flow control valve (20) and/or the refrigerant gas flow control valve (22) on the basis of temperatures measured by the first through third thermometers (23, 26, 27).

4 Claims, 11 Drawing Sheets

(56) References Cited

U.S. PATENT DOCUMENTS

| | | | | |
|---|---|---|---|---|
| 4,936,888 | A | 6/1990 | DeLong | |
| 5,024,061 | A * | 6/1991 | Pfeil et al. | 62/77 |
| 5,493,200 | A * | 2/1996 | Rozman et al. | 322/10 |
| 5,499,531 | A * | 3/1996 | Henderson | 73/64.45 |
| 5,791,160 | A | 8/1998 | Mandler et al. | |
| 6,257,070 | B1 * | 7/2001 | Giallorenzo et al. | 73/861.04 |
| 6,332,336 | B1 * | 12/2001 | Mirsky et al. | 62/613 |
| 6,560,989 | B1 | 5/2003 | Roberts et al. | |
| 6,626,635 | B1 * | 9/2003 | Prowse et al. | 415/1 |
| 2001/0052241 | A1 | 12/2001 | Jain et al. | |
| 2002/0078698 | A1 | 6/2002 | Leisenheimer et al. | |
| 2003/0070546 | A1 | 4/2003 | Zwilling et al. | |
| 2006/0075777 | A1 * | 4/2006 | Howard et al. | 62/626 |
| 2006/0101824 | A1 * | 5/2006 | Takeda et al. | 60/727 |
| 2006/0225876 | A1 | 10/2006 | Shimizu | |
| 2007/0059566 | A1 * | 3/2007 | Kobayashi et al. | 429/13 |
| 2007/0110587 | A1 * | 5/2007 | Takeshita | 417/26 |
| 2007/0240449 | A1 * | 10/2007 | Howard et al. | 62/613 |

FOREIGN PATENT DOCUMENTS

| | | |
|---|---|---|
| RU | 2028567 | 2/1995 |
| RU | 3811 | 3/1997 |
| RU | 70461 | 1/2008 |

OTHER PUBLICATIONS

International Search Report issued Oct. 26, 2010 in International (PCT) Application No. PCT/JP2010/065468 w/partial translation.

Written Opinion of the International Searching Authority issued Oct. 26, 2010 in International (PCT) Application No. PCT/JP2010/065468 w/partial translation.

Chinese Office Action issued Jan. 21, 2013 in corresponding Chinese Patent Application No. 201080019843.6 with English translation.

* cited by examiner

Controller
Driver
$TI_1$
$TI_2$
$TI_3$
$CV_1$
$CV_2$
1
2
3
4
5
10
11
12
13
14
15
16
17
18
20
21
22
23
24
25
26
27
45

5
23
TI1
26
TI2
27
TI3
29
TI4
50
Δ1
51
FX1
52
Δ2
53
FX2
54
TSET1
55
+1
56
+2
57
TC1
58
FX3
59
FX4
20
CV1
22
CV2
70
TSET2
71
TC2
72
MIN
A
B
A−B
PV
SV
MV

GAS TREATMENT DEVICE

TECHNICAL FIELD

The present invention relates to gas treatment equipment.

BACKGROUND ART

As a system configuration of gas treatment equipment including a freezing compressor, a configuration has heretofore been known in which a compressor, a cooler, a separator, and a heat exchanger are connected in series and in which the temperature of the separator is controlled by the cooler. Such a configuration is disclosed in, for example, the following Patent Literature 1<in particular, see FIG. 1 of the following Patent Literature 1>. In other words, in the conventional gas treatment equipment disclosed in the following Patent Literature 1, gas compressed by the compressor is cooled only by the cooler.

PRIOR ART DOCUMENTS

Patent Document

Patent Document 1 U.S. Pat. No. 5,791,160

SUMMARY OF THE INVENTION

Problems to be Solved by the Invention

However, the above-described conventional gas treatment equipment has a problem that the overall efficiency of the gas treatment equipment is low, because the temperature difference between an inlet and an outlet of the cooler is large when the load thereon is heavy.

In view of the above, an object of the present invention is to provide gas treatment equipment capable of performing efficient gas temperature control without being affected by the load.

Means for Solving the Problems

Gas treatment equipment according to a first aspect of the present invention which addresses the above-described problem includes: a compressor which compresses process gas; a heat exchanger which is disposed downstream of the compressor and which cools the process gas in a main flow path of the process gas; a separator which is disposed downstream of the heat exchanger and which separates the process gas and liquefied process gas; an expander which is disposed downstream of the separator and which expands the process gas to obtain power; a refrigerant gas flow rate control valve which regulates a flow rate of refrigerant gas passing through the heat exchanger and thereby cooling the process gas; a branch flow path into which part of the process gas is branched from the main flow path so as not to pass through the heat exchanger; first and second branch flow path heat exchangers which are disposed in the branch flow path and which cool the branched process gas; a first outlet flow path which is connected to a liquefied process gas outlet of the separator and which passes through the first branch flow path heat exchanger; a second outlet flow path which is connected to a process gas outlet of the expander and which passes through the second branch flow path heat exchanger; a first temperature indicator which is disposed between the heat exchanger and a junction of the main flow path and the branch flow path, and which measures a temperature of the process gas; a second temperature indicator which is disposed between the second branch flow path heat exchanger and the junction of the main flow path and the branch flow path, and which measures a temperature of the branched process gas; a third temperature indicator which is disposed in the separator and which measures a temperature of the process gas; a flow rate control valve which is disposed between the heat exchanger and a branching point between the main flow path and the branch flow path, and which regulates a flow rate of the process gas; and control means which controls at least one of the flow rate control valve and the refrigerant gas flow rate control valve on the basis of the temperatures measured by the first to third temperature indicators.

Gas treatment equipment according to a second aspect of the present invention which addresses the above-described problem further includes a first pressure indicator which is disposed in the separator and which measures a pressure in the gas treatment equipment according to the first aspect. In the gas treatment equipment, the control means controls at least one of the flow rate control valve and the refrigerant gas flow rate control valve on the basis of the temperatures measured by the first to third temperature indicators and the pressure measured by the first pressure indicator.

Gas treatment equipment according to a third aspect of the present invention which addresses the above-described problem further includes a second heat exchanger and a second separator which are disposed between the separator and the expander, and a fourth temperature indicator which is disposed in the second separator and which measures a temperature of the process gas in the gas treatment equipment according to the first aspect. In the gas treatment equipment, the control means controls at least one of the flow rate control valve and the refrigerant gas flow rate control valve on the basis of the temperatures measured by the first to fourth temperature indicators.

Gas treatment equipment according to a third aspect of the present invention which addresses the above-described problem further includes a first pressure indicator which is disposed in the separator and which measures a pressure, and a second pressure indicator which is disposed in the second separator and which measures a pressure in the gas treatment equipment according to the third aspect. In the gas treatment equipment, the control means controls at least one of the flow rate control valve and the refrigerant gas flow rate control valve on the basis of the temperatures measured by the first to fourth temperature indicators and the pressures measured by the first and second pressure indicators.

Effects of the Invention

The present invention makes it possible to provide gas treatment equipment capable of performing efficient gas temperature control without being affected by the load.

MODE FOR CARRYING OUT THE INVENTION

Hereinafter, modes for implementing gas treatment equipment according to the present invention will be described with reference to the accompanying drawings.

Embodiment 1

Hereinafter, a first example of gas treatment equipment according to the present invention will be described.

First, the configuration of the gas treatment equipment according to the first example of the present invention will be described.

It should be noted that a facility serving as a supply source of process gas is located upstream of the gas treatment equipment according to this example, and that a facility using the treated process gas is located downstream thereof. However, they will not be described here.

Figure 1:
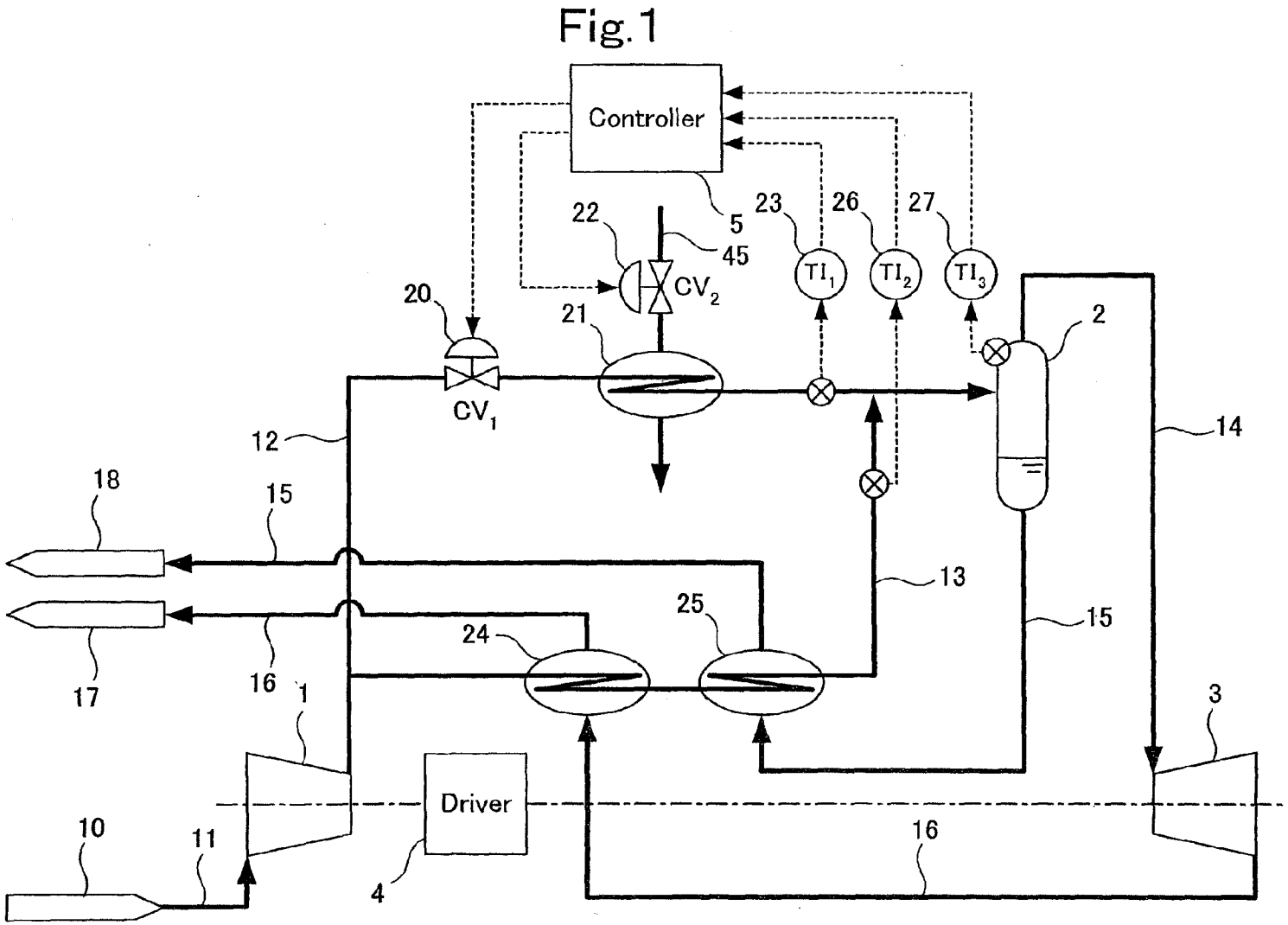
FIG. 1 is a schematic diagram showing the configuration of gas treatment equipment according to a first example of the present invention.

FIG. 1 is a schematic diagram showing the configuration of the gas treatment equipment according to the first example of the present invention.

As shown in FIG. 1, the gas treatment equipment according to the present example includes a compressor 1 for compressing the process gas supplied from the upstream facility, a first separator 2 placed downstream of the compressor 1 to separate the process gas and liquefied process gas, and an expander 3 placed downstream of the first separator 2 to expand the process gas and thus obtain power.

A first flow path 11 is connected to a process gas inlet of the compressor 1. At an end portion of the first flow path 11, a process gas inlet 10 is placed which is connected to the upstream facility. Between a process gas outlet of the compressor 1 and a process gas inlet of the first separator 2, a second flow path 12 is placed.

In the second flow path 12, a flow rate control valve ($CV_1$) 20 is placed to regulate the flow rate of the process gas. In the second flow path 12, a first heat exchanger 21 for cooling the process gas is placed downstream of the flow rate control valve 20. In the second flow path 12, a first temperature indicator ($TI_1$) 23 for measuring the temperature of the process gas is placed downstream of the first heat exchanger 21.

To the first heat exchanger 21, a refrigerant flow path 45 is connected through which refrigerant gas flows. The refrigerant gas passes through the first heat exchanger 21 in order to cool the process gas. In the refrigerant flow path 45, a refrigerant gas flow rate control valve 22 is placed to regulate the flow rate of the refrigerant gas flowing through the refrigerant flow path 45. It should be noted that some type of cooling device is needed to appropriately cool the refrigerant gas flowing through the refrigerant flow path 45 but will not be described here because an existing cooling device can be used.

A branch flow path 13 into which part of the process gas is branched from the second flow path 12 is placed from a point between the compressor 1 and the flow rate control valve 32 to a point between the first temperature indicator 23 and the first separator 2. It should be noted that the second flow path 12 is a main flow path of the process gas.

In the branch flow path 13, a first branch flow path heat exchanger 24 is placed to cool the branched process gas. In the branch flow path 13, a second branch flow path heat exchanger 25 is placed downstream of the first branch flow path heat exchanger 24. In the branch flow path 13, a second temperature indicator ($TI_2$) 26 for measuring the temperature of the branched process gas is placed downstream of the second branch flow path heat exchanger 25.

Between a process gas outlet of the first separator 2 and a process gas inlet of the expander 4, a third flow path 14 is placed. To a process gas outlet of the expander 3, a fifth flow path 16 is connected which passes through the first branch flow path heat exchanger 24. At an end portion of the fifth flow path 16, a first process gas outlet 17 is placed which is connected to a downstream facility using the treated process gas.

To a liquefied process gas outlet of the first separator 2, a fourth flow path 15 is connected which passes through the second branch flow path heat exchanger 25. At an end portion of the fourth flow path 15, a second process gas outlet 18 is placed which is connected to a downstream facility using the treated liquefied process gas. In the first separator 2, a third temperature indicator ($TI_3$) 27 is placed to measure the temperature of the first separator 2.

The gas treatment equipment according to this example includes a controller 5 which controls the flow rate control valve 20 and the refrigerant gas flow rate control valve 22 based on the temperatures measured by the first to third temperature indicators 23, 26, and 27. The controller 5 performs control such that the temperature difference between the process gas flowing through the second flow path 12 and the branched process gas flowing through the branch flow path 13 may be small at the junction thereof.

Next, a method of controlling the gas treatment equipment according to the first example will be described.

Figure 5:
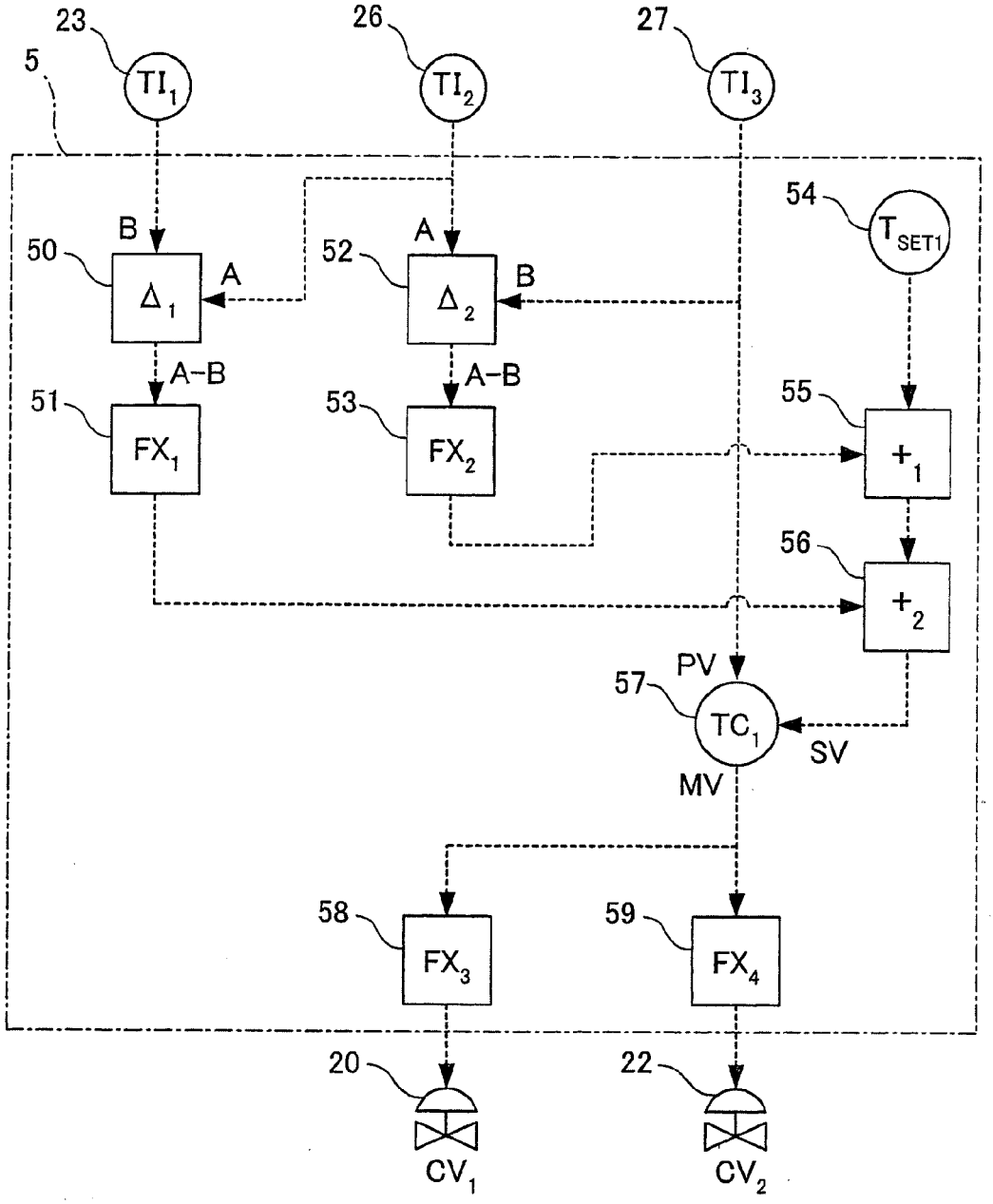
FIG. 5 is a control block diagram of the gas treatment equipment according to the first example of the present invention.

FIG. 5 is a control block diagram of the gas treatment equipment according to the first example of the present invention.

As shown in FIG. 5, the controller 5 of the gas treatment equipment according to this example includes first and second subtractors ($\Delta_1$ and $\Delta_2$) 50 and 52 each of which performs a subtraction between inputted values, a first function generator ($FX_1$) 51, a second function generator ($FX_2$) 53, a first temperature setter ($T_{SET1}$) 54 which outputs a predetermined set value, first and second adders ($+_1$ and $+_2$) 55 and 56 each of which performs an addition of inputted values, a first temperature controller ($TC_1$) 57, a third function generator ($FX_3$) 58, and a fourth function generator ($FX_4$) 59.

Here, input-output characteristics of the first to fourth function generators 51, 53, 58, and 59 will be described.

Figure 9:
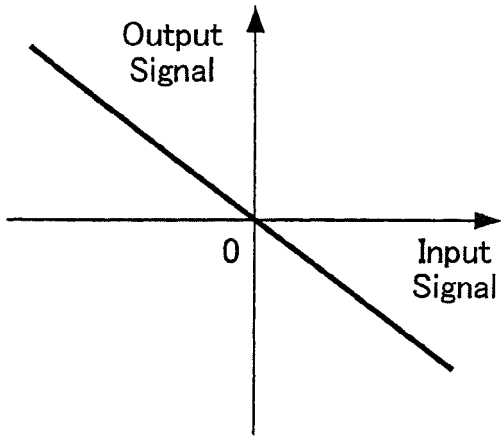
FIG. 9 is a view showing input-output characteristics of a first function generator of the gas treatment equipment according to the first example of the present invention.

FIG. 9 is a view showing input-output characteristics of the first function generator 51 of the gas treatment equipment according to the first example of the present invention.

As shown in FIG. 9, the first function generator 51 of the controller 5 according to this example has input-output characteristics in which the output decreases linearly with the input.

Figure 10:
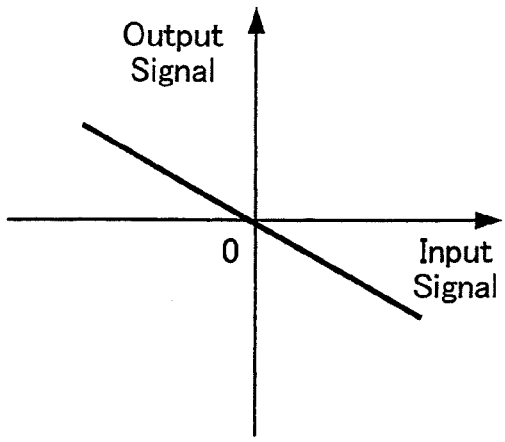
FIG. 10 is a view showing input-output characteristics of a second function generator of the gas treatment equipment according to the first example of the present invention.

FIG. 10 is a view showing input-output characteristics of the second function generator 53 of the gas treatment equipment according to the first example of the present invention.

As shown in FIG. 10, the second function generator 53 of the controller 5 according to this example has input-output characteristics in which the output decreases linearly with the input. It should be noted that in this example, the output-to-input ratio of the second function generator 53 is set smaller than that of the first function generator 51.

Figure 11:
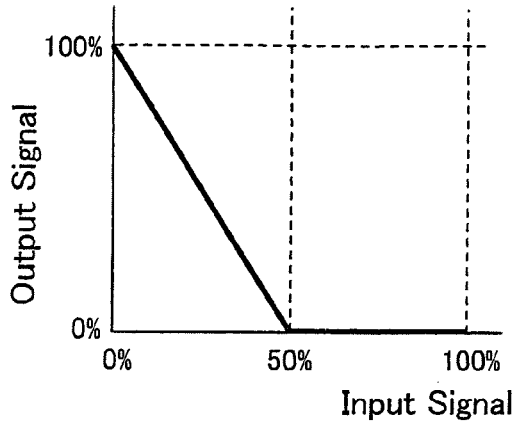
FIG. 11 is a view showing input-output characteristics of a third function generator of the gas treatment equipment according to the first example of the present invention.

FIG. 11 is a view showing input-output characteristics of the third function generator 58 of the gas treatment equipment according to the first example of the present invention.

As shown in FIG. 11, input-output characteristics of the third function generator 58 of the controller 5 according to this example are set as follows with the input being represented in the range of 0% to 100% in accordance with the value of an inputted signal: in the region in which the input is 0% to 50%, the output decreases linearly; in the region in which the input is 50% to 100%, the output is set to 0%.

Figure 12:
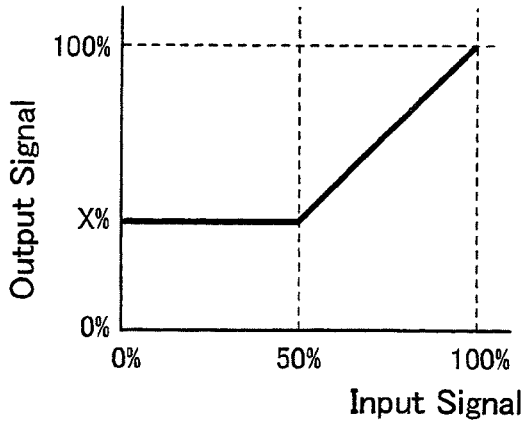
FIG. 12 is a view showing input-output characteristics of a fourth function generator of the gas treatment equipment according to the first example of the present invention.

FIG. 12 is a view showing input-output characteristics of the fourth function generator 59 of the gas treatment equipment according to the first example of the present invention.

As shown in FIG. 12, input-output characteristics of the fourth function generator 59 of the controller 5 according to this example are set as follows with the input being represented in the range of 0% to 100% in accordance with the value of an inputted signal: in the region in which the input is 0% to 50%, the output is set to a predetermined value X%; in the region in which the input is 50% to 100%, the output increases linearly.

In the controller 5 of the gas treatment equipment according to this example, the first subtractor 50 receives signals from the first and second temperature indicators 23 and 26, and outputs to the first function generator 51 the value obtained by subtracting the signal value of the first temperature indicator 23 from the signal value of the second temperature indicator 26.

Further, in the controller 5, the second subtractor 52 receives signals from the second and third temperature indicators 26 and 27, and outputs to the second function generator 53 the value obtained by subtracting the signal value of the third temperature indicator 27 from the signal value of the second temperature indicator 26.

Moreover, in the controller 5, the first adder 55 receives signals from the second function generator 53 and the first temperature setter 54, and outputs to the second adder 56 the value obtained by adding the signal value of the second function generator 53 and the signal value of the first temperature setter 54.

Furthermore, in the controller 5, the second adder 56 receives signals from the first function generator 51 and the first adder 55, and outputs to the first temperature controller 57 the value obtained by adding the signal value of the first function generator 51 and the signal value of the first adder 55.

Also, in the controller 5, the first temperature controller 57 receives signals from the third temperature indicator 27 and the second adder 56, and outputs a temperature control signal to the third and fourth function generators 58 and 59 based on the signal values of the third temperature indicator 27 and the second adder 56.

Further, in the controller 5, the third function generator 58 receives the temperature control signal from the first temperature controller 57, and produces an output in accordance with the value of the received temperature control signal. The output from the third function generator 58 is used to control the flow rate control valve 20.

Moreover, in the controller 5, the fourth function generator 59 receives the temperature control signal from the first temperature controller 57, and produces an output in accordance with the value of the received temperature control signal. The output from the fourth function generator 59 is used to control the refrigerant gas flow rate control valve 22.

As described above, in the gas treatment equipment of this example, the branched process gas flowing through the branch flow path 13 is cooled by the first and second branch flow path heat exchangers 24 and 25. This reduces the load on a cooling device for cooling the refrigerant gas which passes through the first heat exchanger 21 in order to cool the process gas flowing through the second flow path 12. Accordingly, gas temperature control can be performed efficiently without being affected by the load.

Embodiment 2

Hereinafter, a second example of gas treatment equipment according to the present invention will be described.

First, the configuration of the gas treatment equipment according to the second example of the present invention will be described.

Figure 2:
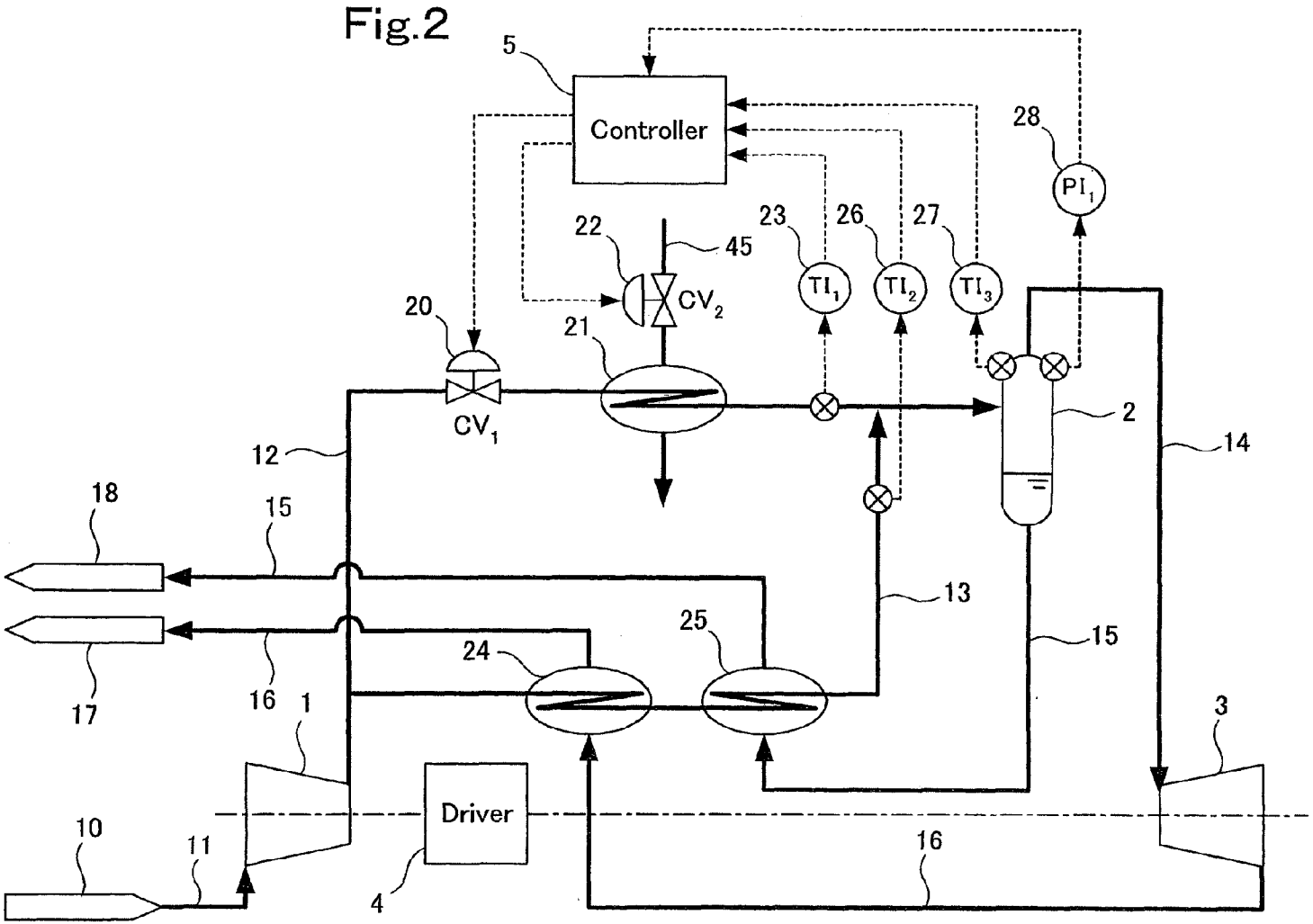
FIG. 2 is a schematic diagram showing the configuration of gas treatment equipment according to a second example of the present invention.

FIG. 2 is a schematic diagram showing the configuration of the gas treatment equipment according to the second example of the present invention.

As shown in FIG. 2, the gas treatment equipment according to this example has approximately the same configuration as the gas treatment equipment according to the first example, but further includes a first pressure indicator ($PI_1$) 28 for measuring the pressure in the first separator 2.

Next, a method of controlling the gas treatment equipment according to the second example of the present invention will be described.

Figure 6:
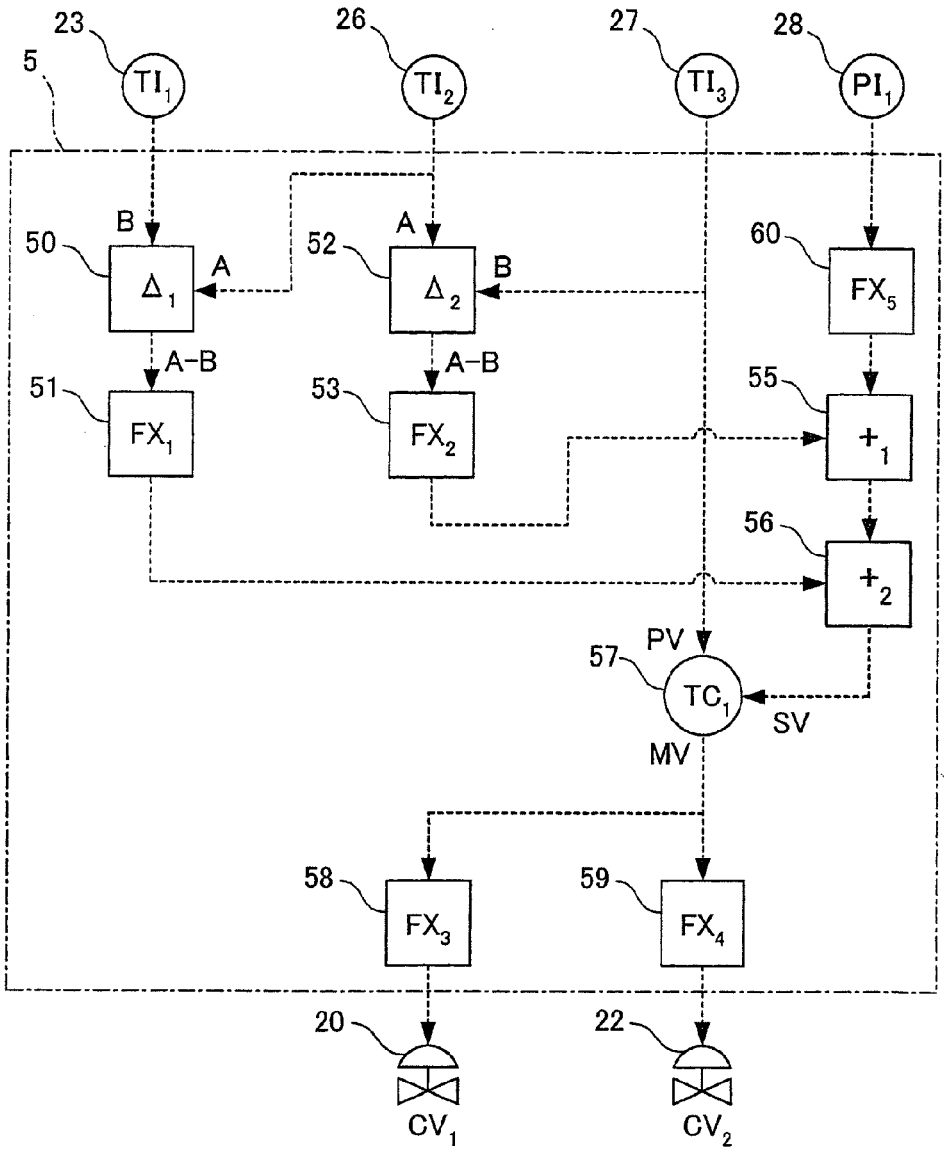
FIG. 6 is a control block diagram of the gas treatment equipment according to the second example of the present invention.

FIG. 6 is a control block diagram of the gas treatment equipment according to the second example of the present invention.

As shown in FIG. 6, the controller 5 of the gas treatment equipment according to this example has approximately the same configuration as the controller 5 of the gas treatment equipment according to the first example, but includes a fifth function generator ($FX_5$) 60 instead of the first temperature setter 54.

Here, input-output characteristics of the fifth function generator 60 will be described.

Figure 13:
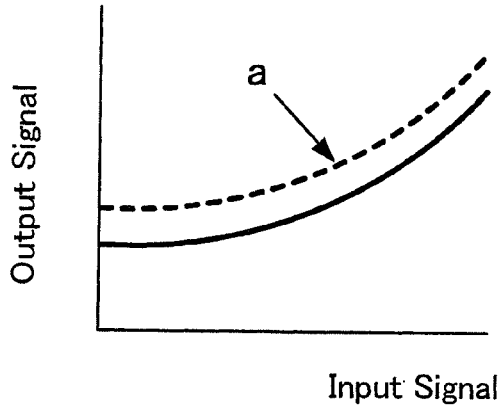
FIG. 13 is a view showing input-output characteristics of a fifth function generator of the gas treatment equipment according to the second example of the present invention.

FIG. 13 is a view showing the input-output characteristics of the fifth function generator 60 of the gas treatment equipment according to the second example of the present invention.

As shown in FIG. 13, the fifth function generator 60 of the controller 5 according to this example has input-output characteristics represented by a characteristic curve extending along and below the curve which represents the relationship between the input and the output when the process gas reaches saturation and which is indicated by arrow a in FIG. 13.

Unlike in the controller 5 of the gas treatment equipment according to the first example, in the controller 5 of the gas treatment equipment according to this example, the fifth function generator 60 receives the signal from the first pressure indicator 28, and outputs a signal to the first adder 55 in accordance with the signal value of the first pressure indicator 28.

Thus, in addition to effects of the first example, the gas treatment equipment according to this example can perform control such that the temperature difference between the process gas flowing through the second flow path 12 and the branched process gas flowing through the branch flow path 13 may be further smaller at the junction thereof, because the actual pressure in the first separator 2 is used. Accordingly, gas temperature control can be performed more efficiently without being affected by the load.

Embodiment 3

Hereinafter, a third example of gas treatment equipment according to the present invention will be described.

First, the configuration of the gas treatment equipment according to the third example of the present invention will be described.

Figure 3:
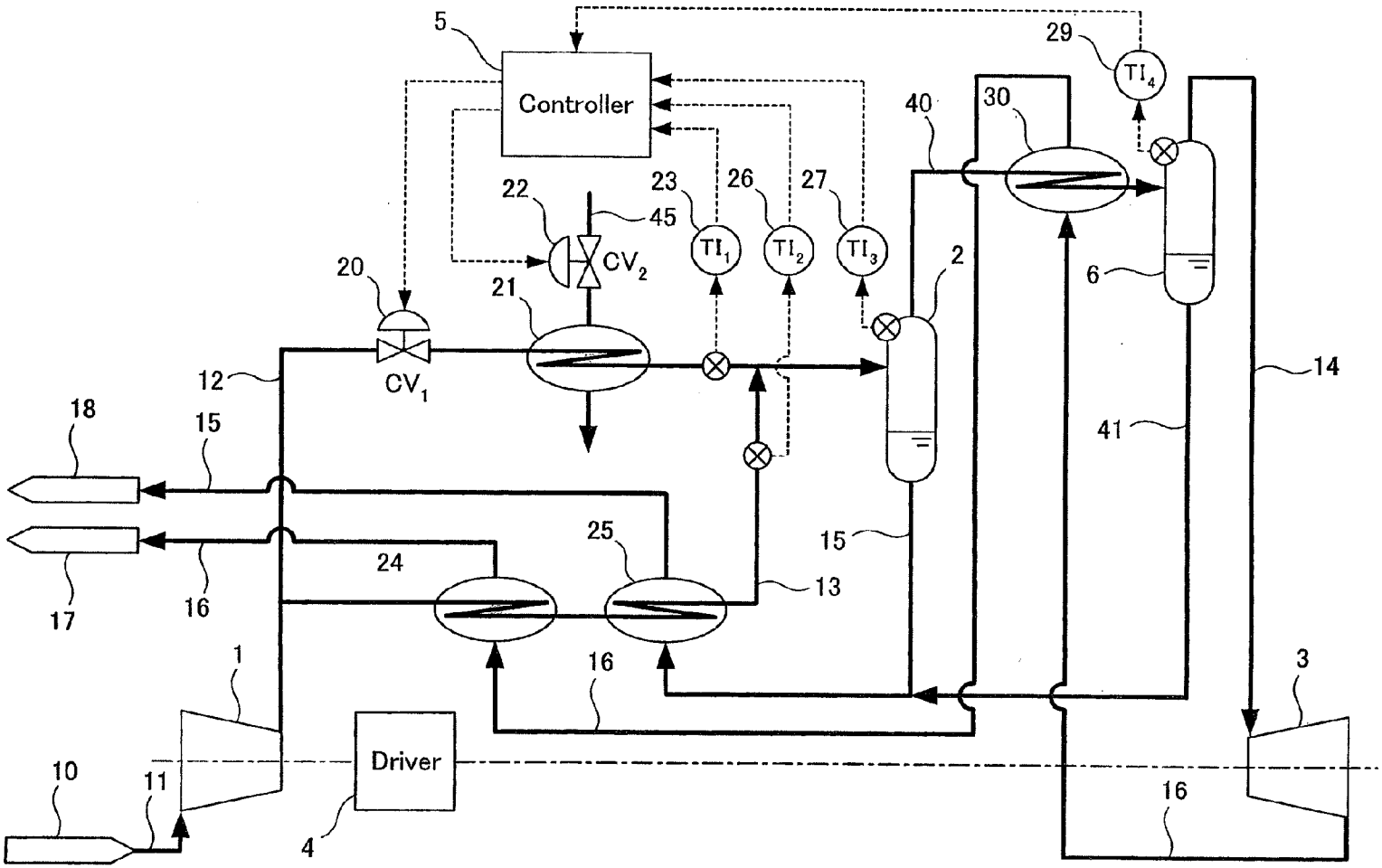
FIG. 3 is a schematic diagram showing the configuration of gas treatment equipment according to a third example of the present invention.

FIG. 3 is a schematic diagram showing the configuration of the gas treatment equipment according to the third example of the present invention.

As shown in FIG. 3, the gas treatment equipment according to this example has approximately the same configuration as the gas treatment equipment according to the first example, but further includes a second heat exchanger 30, a second separator 6, and a fourth temperature indicator ($TI_4$) 29. The second heat exchanger 30 and the second separator 6 are placed between the first separator 2 and the expander 3. The fourth temperature indicator 29 is placed to measure the temperature of the process gas in the second separator 6.

In the gas treatment equipment according to this example, a sixth flow path 40 is placed between the process gas outlet of the first separator 2 and a process gas inlet of the second separator 6. In the sixth flow path 40, the second heat exchanger 30 is placed to cool the process gas. The third flow path 14 is placed between a process gas outlet of the second separator 6 and the process gas inlet of the expander 3.

To the process gas outlet of the expander 3, the fifth flow path 16 is connected which passes through the second heat exchanger 30 and then through the first branch flow path heat exchanger 24. To a liquefied process gas outlet of the second separator 6, a seventh flow path 41 is connected. The seventh flow path 41 is connected to the fourth flow path 15.

Next, a method of controlling the gas treatment equipment according to the third example of the present invention will be described.

Figure 7:
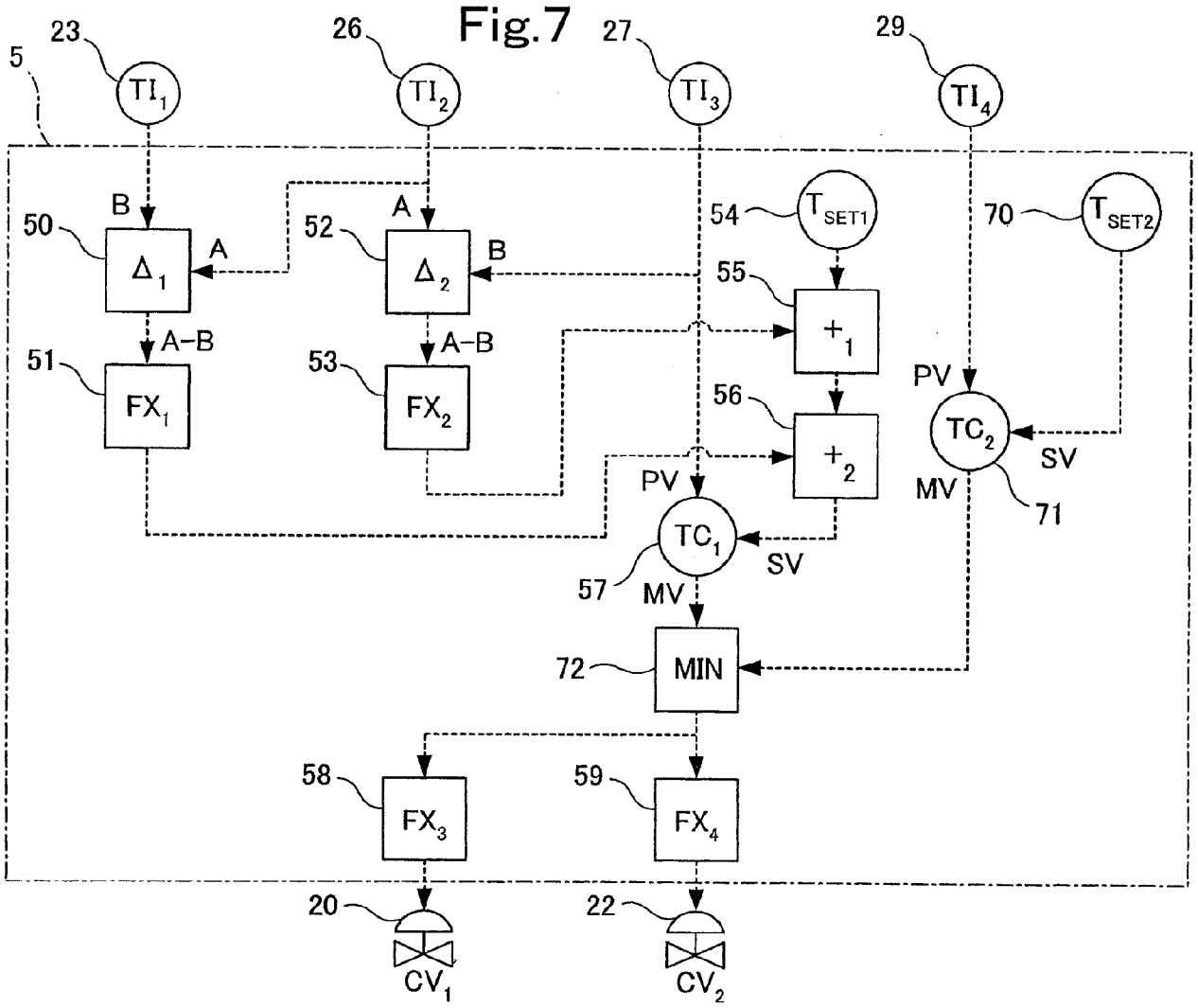
FIG. 7 is a control block diagram of the gas treatment equipment according to the third example of the present invention.

FIG. 7 is a control block diagram of the gas treatment equipment according to the third example of the present invention.

As shown in FIG. 7, the controller 5 of the gas treatment equipment according to this example has approximately the same configuration as the controller 5 of the gas treatment equipment according to the first example, but further includes a second temperature setter ($T_{SET2}$) 70 which outputs a predetermined set value, a second temperature controller ($TC_2$) 71, and a minimum selector (MIN) 72.

Unlike in the controller 5 of the gas treatment equipment according to the first example, in the controller 5 of the gas treatment equipment according to this example, the second temperature controller 71 receives signals from the fourth temperature indicator 29 and the second temperature setter 70, and outputs a signal to the minimum selector 72 in accordance with the signal value of the fourth temperature indicator 29 and the signal value of the second temperature setter 70.

Further, in the controller 5, the minimum selector 72 receives temperature control signals from the first and second temperature controllers 57 and 71, compares the values of the temperature control signals from the first and second temperature controllers 57 and 71, and outputs the smaller one of these signals to the third and fourth function generators 58 and 59.

Thus, in addition to effects of the first example, the gas treatment equipment according to this example can perform gas temperature control more efficiently without being affected by the load, because of the inclusion of the first and second separators 2 and 6. It should be noted that though the first and second separators 2 and 6 are installed in this example, more separators may be installed.

Embodiment 4

Hereinafter, a fourth example of gas treatment equipment according to the present invention will be described.

First, the configuration of the gas treatment equipment according to the fourth example of the present invention will be described.

Figure 4:
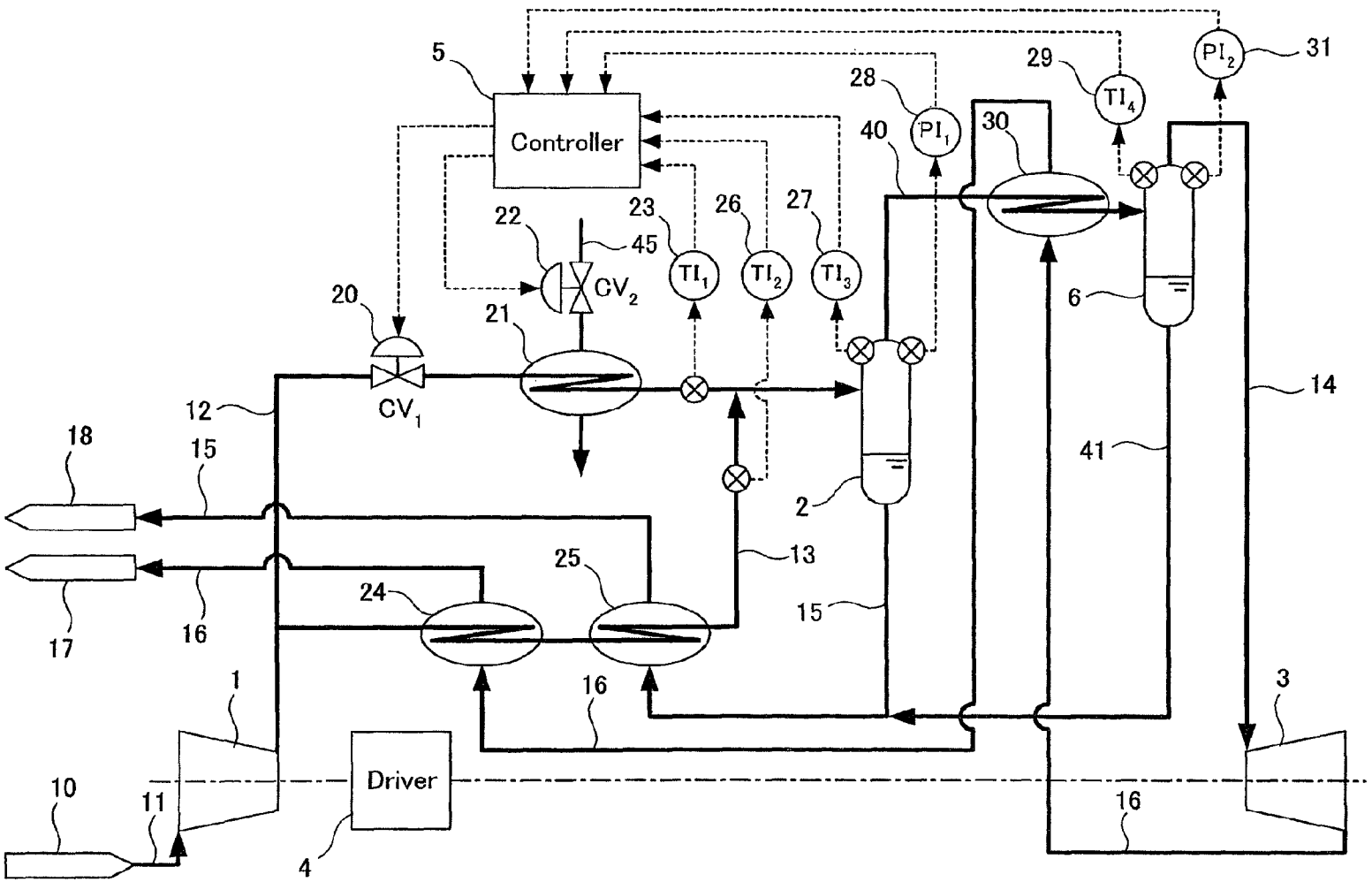
FIG. 4 is a schematic diagram showing the configuration of gas treatment equipment according to a fourth example of the present invention.

FIG. 4 is a schematic diagram showing the configuration of the gas treatment equipment according to the fourth example of the present invention.

As shown in FIG. 4, the gas treatment equipment according to this example has approximately the same configuration as the gas treatment equipment according to the third example, but further includes the first pressure indicator ($PI_1$) 28 for measuring the pressure in the first separator 2 and a second pressure indicator ($PI_2$) 31 for measuring the pressure in the second separator 6.

Next, a method of controlling the gas treatment equipment according to the fourth example of the present invention will be described.

Figure 8:
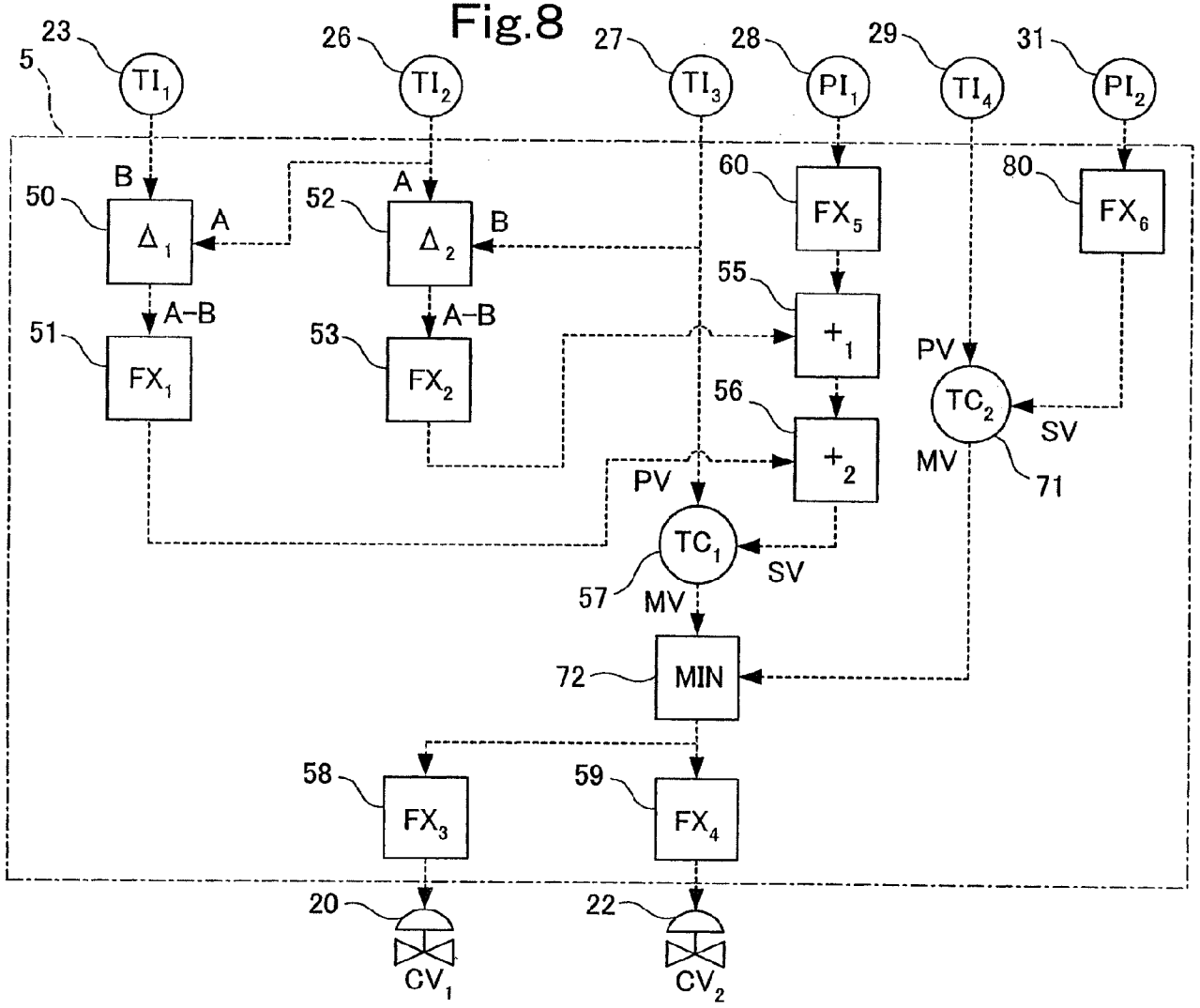
FIG. 8 is a control block diagram of the gas treatment equipment according to the fourth example of the present invention.

FIG. 8 is a control block diagram of the gas treatment equipment according to the fourth example of the present invention.

As shown in FIG. 8, the controller 5 of the gas treatment equipment according to this example has approximately the same configuration as the controller 5 of the gas treatment equipment according to the third example, but includes the fifth function generator 60 instead of the first temperature setter 54, and a sixth function generator ($FX_6$) 80 instead of the second temperature setter 70.

Here, input-output characteristics of the sixth function generator 80 will be described. It should be noted that input-output characteristics of the fifth function generator 60 are the same as those described in the second example.

Figure 14:
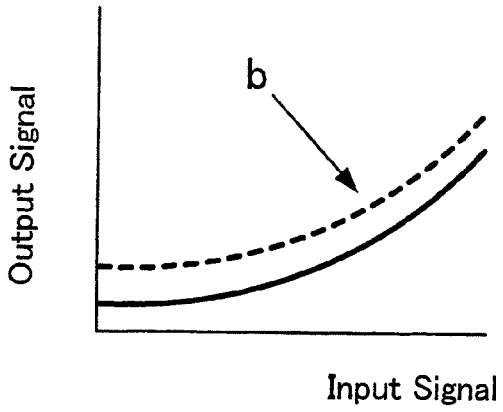
FIG. 14 is a view showing input-output characteristics of a sixth function generator of the gas treatment equipment according to the fourth example of the present invention.

FIG. 14 is a view showing the input-output characteristics of the sixth function generator 80 of the gas treatment equipment according to the fourth example of the present invention.

As shown in FIG. 14, the sixth function generator 80 of the controller 5 according to this example has input-output characteristics represented by a characteristic curve extending along and below the curve which represents the relationship between the input and the output when the process gas reaches saturation and which is indicated by arrow b in FIG. 14. It should be noted that in this example, the output-to-input ratio of the sixth function generator 80 is set smaller than that of the fifth function generator 60.

Unlike in the controller 5 of the gas treatment equipment according to the third example, in the controller 5 of the gas treatment equipment according to this example, the sixth function generator 80 receives the signal from the second pressure indicator 31 and outputs a signal to the second temperature controller 71 in accordance with the signal value of the second pressure indicator 31.

Thus, in addition to effects of the third example, the gas treatment equipment according to this example can perform control such that the temperature difference between the process gas flowing through the second flow path 12 and the branched process gas flowing through the branch flow path 13 may be further smaller at the junction thereof, because the actual pressures in the first and second separators 2 and 6 are used. Accordingly, gas temperature control can be performed more efficiently without being affected by the load even in the case where the first and second separators 2 and 6 are installed.

INDUSTRIAL APPLICABILITY

The present invention can be applied to, for example, gas treatment equipment which includes a freezing compressor.

Description of the Numerals

1 COMPRESSOR
2 FIRST SEPARATOR
3 EXPANDER
4 DRIVER
5 CONTROLLER
6 SECOND SEPARATOR
10 PROCESS GAS INLET
11 FIRST FLOW PATH
12 SECOND FLOW PATH
13 BRANCH FLOW PATH
14 THIRD FLOW PATH
15 FOURTH FLOW PATH
16 FIFTH FLOW PATH
17 FIRST PROCESS GAS OUTLET
18 SECOND PROCESS GAS OUTLET
20 FLOW RATE CONTROL VALVE ($CV_1$)
21 FIRST HEAT EXCHANGER
22 REFRIGERANT GAS FLOW RATE CONTROL VALVE ($CV_2$)
23 FIRST TEMPERATURE INDICATOR ($TI_1$)
24 FIRST BRANCH FLOW PATH HEAT EXCHANGER
25 SECOND BRANCH FLOW PATH HEAT EXCHANGER
26 SECOND TEMPERATURE INDICATOR ($TI_2$)
27 THIRD TEMPERATURE INDICATOR ($TI_3$)
28 FIRST PRESSURE INDICATOR ($PI_1$)
29 THIRD TEMPERATURE INDICATOR ($TI_4$)
30 Second Heat Exchanger
31 SECOND PRESSURE INDICATOR ($PI_2$)
40 SIXTH FLOW PATH
41 SEVENTH FLOW PATH
45 REFRIGERANT FLOW PATH
50 FIRST SUBTRACTOR ($\Delta_1$)
51 FIRST FUNCTION GENERATOR ($FX_1$)
52 SECOND SUBTRACTOR ($\Delta_2$)
53 SECOND FUNCTION GENERATOR ($FX_2$)
54 FIRST TEMPERATURE SETTER ($T_{SET1}$)
55 FIRST ADDER ($+_1$)
56 SECOND ADDER ($+_2$)
57 FIRST TEMPERATURE CONTROLLER ($TC_1$)
58 THIRD FUNCTION GENERATOR ($FX_3$)
59 FOURTH FUNCTION GENERATOR ($FX_4$)
60 FIFTH FUNCTION GENERATOR ($FX_5$)
70 SECOND TEMPERATURE SETTER ($T_{SET2}$)
71 SECOND TEMPERATURE CONTROLLER ($TC_2$)
72 MINIMUM SELECTOR (MIN)
80 SIXTH FUNCTION GENERATOR ($FX_6$)

The invention claimed is:

1. Gas treatment equipment comprising:

a compressor which compresses process gas;

a heat exchanger which is disposed downstream of the compressor and which cools the process gas in a main flow path of the process gas;

a separator which is disposed downstream of the heat exchanger and which separates the process gas and liquefied process gas;

an expander which is disposed downstream of the separator and which expands the process gas to obtain power;

a refrigerant gas flow rate control valve which regulates a flow rate of refrigerant gas passing through the heat exchanger and thereby cooling the process gas;

a branch flow path into which part of the process gas is branched from the main flow path so as not to pass through the heat exchanger;

first and second branch flow path heat exchangers which are disposed in the branch flow path and which cool the branched process gas;

a first outlet flow path which is connected to a process gas outlet of the expander and which passes through the first branch flow path heat exchanger;

a second outlet flow path which is connected to a liquefied process gas outlet of the separator and which passes through the second branch flow path heat exchanger;

a first temperature indicator which is disposed between the heat exchanger and a junction of the main flow path and the branch flow path, and which measures a temperature of the process gas;

a second temperature indicator which is disposed between the second branch flow path heat exchanger and the junction of the main flow path and the branch flow path, and which measures a temperature of the branched process gas;

a third temperature indicator which is disposed in the separator and which measures a temperature of the process gas;

a flow rate control valve which is disposed between the heat exchanger and a branching point between the main flow path and the branch flow path, and which regulates a flow rate of the process gas; and a controller which controls the flow rate control valve and the refrigerant gas flow rate control valve on the basis of the temperatures measured by the first to third temperature indicators, wherein the controller comprises:

a first function generator which has input-output characteristics in which an output decreases linearly with an input;

a second function generator which has input-output characteristics in which an output decreases linearly with an input;

a third function generator which has input-output characteristics in which an output decreases linearly with an input in a region in which the input is 0% to 50% and the output is set to 0% in a region in which the input is 50% to 100%; and a fourth function generator which has input-output characteristics in which an output is set to a predetermined value in a region in which the input is 0% to 50% and the output increases from the predetermined value linearly according to an increase of the input in a region in which the input is 50% to 100%, wherein an additional value obtained by adding a signal value outputted from the first function generator when a value obtained by subtracting a signal value of the first temperature indicator from a signal value of the second temperature indicator is inputted into the first function generator, a signal value outputted from the second function generator when a value obtained by subtracting a signal value of the third temperature indicator from the signal value of the second temperature indicator is inputted into the second function generator, the signal value of the third temperature indicator, and a set signal value corresponding to a predetermined set temperature is inputted into the third function generator and the fourth function generator, wherein an opening degree of the flow rate control valve is controlled in response to a signal value outputted from the third function generator, and wherein an opening degree of the refrigerant gas flow rate control valve is controlled in response to a signal value outputted from the fourth function generator.

2. The gas treatment equipment according to claim 1, further comprising a first pressure indicator which is disposed in the separator and which measures a pressure, wherein the controller controls the flow rate control valve and the refrigerant gas flow rate control valve on the basis of the temperatures measured by the first to third temperature indicators and the pressure measured by the first pressure indicator, wherein the controller further comprises a fifth function generator which has input-output characteristics represented by a characteristic curve extending along and below a curve which represents a relationship between an input and an output when the process gas reaches saturation, wherein an additional value obtained by adding the signal value outputted from the first function generator when the value obtained by subtracting the signal value of the first temperature indicator from the signal value of the second temperature indicator is inputted into the first function generator, the signal value outputted from the second function generator when the value obtained by subtracting the signal value of the third temperature indicator from the signal value of the second temperature indicator is inputted into the second function generator, the signal value of the third temperature indicator, and a signal value outputted from the fifth function generator when a signal value of the first pressure indicator is inputted into the fifth function generator is inputted into the third function generator and the fourth function generator, wherein the opening degree of the flow rate control valve is controlled in response to the signal value outputted from the third function generator, and wherein the opening degree of the refrigerant gas flow rate control valve is controlled in response to the signal value outputted from the fourth function generator.

3. The gas treatment equipment according to claim 1, further comprising:

a second heat exchanger and a second separator which are disposed between the separator and the expander; and a fourth temperature indicator which is disposed in the second separator and which measures a temperature of the process gas, wherein the controller controls the flow rate control valve and the refrigerant gas flow rate control valve on the basis of the temperatures measured by the first to fourth temperature indicators, wherein the controller further comprises a minimum selector, wherein a first additional value obtained by adding the signal value outputted from the first function generator when the value obtained by subtracting the signal value of the first temperature indicator from the signal value of the second temperature indicator is inputted into the first function generator, the signal value outputted from the second function generator when the value obtained by subtracting the signal value of the third temperature indicator from the signal value of the second temperature indicator is inputted into the second function generator, the signal value of the third temperature indicator, and a first set signal value corresponding to a predetermined first set temperature is obtained, wherein a second additional value obtained by adding a signal value of the fourth temperature indicator and a second set signal value corresponding to a predetermined second set temperature is obtained, wherein the minimum selector selects a smaller additional value from the first additional value and the second additional value and inputs the selected smaller additional value into the third function generator and the fourth function generator, wherein the opening degree of the flow rate control valve is controlled in response to the signal value outputted from the third function generator, and wherein the opening degree of the refrigerant gas flow rate control value is controlled in response to the signal value outputted from the fourth function generator.

4. The gas treatment equipment according to claim 3, further comprising:

a first pressure indicator which is disposed in the separator and which measures a pressure; and a second pressure indicator which is disposed in the second separator and which measures a pressure, wherein the controller controls the flow rate control valve and the refrigerant gas flow rate control valve on the basis of the temperatures measured by the first to fourth temperature indicators and the pressures measured by the first and second pressure indicators, wherein the controller further comprises:

a fifth function generator which has input-output characteristics represented by a characteristic curve extending along and below a curve which represents a relationship between an input and an output when the process gas reaches saturation, and a sixth function generator which has input-output characteristics represented by a characteristic curve extending along and below the curve which represents the relationship between an input and an output when the process gas reaches saturation, and wherein a first additional value obtained by adding the signal value outputted from the first function generator when the value obtained by subtracting the signal value of the first temperature indicator from the signal value of the second temperature indicator is inputted into the first function generator, the signal value outputted from the second function generator when the value obtained by subtracting the signal value of the third temperature indicator from the signal value of the second temperature indicator is inputted into the second function generator, the signal value of the third temperature indicator, and a signal value outputted from the fifth function generator when a signal value of the first pressure indicator is inputted into the fifth function generator is obtained, wherein a second additional value obtained by adding the signal value of the fourth temperature indicator and a signal value outputted from the sixth function generator when a signal value of the second pressure indicator is inputted into the sixth function generator is obtained, wherein the minimum selector selects the smaller additional value from the first additional value and the second additional value and inputs the selected smaller additional value into the third function generator and the fourth function generator, wherein the opening degree of the flow rate control valve is controlled in response to the signal value outputted from the third function generator, and wherein the opening degree of the refrigerant gas flow rate control value is controlled in response to the signal value outputted from the fourth function generator.

* * * * *